US006279769B1

(12) United States Patent
Duvander et al.

(10) Patent No.: US 6,279,769 B1
(45) Date of Patent: Aug. 28, 2001

(54) DEVICE FOR FORMING A MOUTH IN A CONTAINER

(75) Inventors: Patrik Duvander, Lund (SE); Elmar Mock, Biel; Andre Klopfenstein, Mont-Crosin, both of (CH)

(73) Assignee: Tetra Laval Holdings & Finance S.A. (CH)

( * ) Notice: Subject to any disclaimer, the term of this patent is extended or adjusted under 35 U.S.C. 154(b) by 0 days.

(21) Appl. No.: 09/171,985

(22) PCT Filed: Apr. 28, 1997

(86) PCT No.: PCT/US97/06375

§ 371 Date: Apr. 30, 1999

§ 102(e) Date: Apr. 30, 1999

(87) PCT Pub. No.: WO97/41040

PCT Pub. Date: Nov. 6, 1997

(30) Foreign Application Priority Data

Apr. 30, 1996 (JP) ..... 8-132855

(51) Int. Cl.[7] ..... B65D 17/30
(52) U.S. Cl. ..... 220/269; 222/83; 229/204
(58) Field of Search ..... 222/83; 229/204; 220/267, 269

(56) References Cited

U.S. PATENT DOCUMENTS

| | | | |
|---|---|---|---|
| 4,544,079 | | 10/1985 | Elrick . |
| 4,907,722 | | 3/1990 | Ueda et al. . |
| 4,913,294 | | 4/1990 | Giacomelli . |
| 4,925,034 | | 5/1990 | Robichaud et al. . |
| 4,930,683 | | 6/1990 | Färber . |
| 4,948,015 | * | 8/1990 | Kawajiri et al. ..... 222/107 |
| 5,069,372 | * | 12/1991 | Kawajiri ..... 222/541 |
| 5,101,999 | | 4/1992 | Robichaud et al. . |
| 5,103,973 | | 4/1992 | Sato . |
| 5,190,149 | * | 3/1993 | Krause ..... 220/269 |
| 5,522,521 | * | 6/1996 | Nagashio ..... 220/269 |
| 5,755,359 | * | 5/1998 | Joensson ..... 229/204 |
| 5,806,757 | * | 9/1998 | Per et al. ..... 229/204 |
| 5,875,959 | * | 3/1999 | Weiteder et al. ..... 229/125.15 |
| 5,947,316 | * | 9/1999 | Guillonnet ..... 220/269 |

FOREIGN PATENT DOCUMENTS

| | | |
|---|---|---|
| 0 760 339 | 3/1997 | (EP) . |
| 95/33656 | 12/1995 | (WO) . |

* cited by examiner

*Primary Examiner*—Stephen P. Garbe
(74) *Attorney, Agent, or Firm*—Burns, Doane, Swecker & Mathis, L.L.P.

(57) ABSTRACT

A mouth forming device for a container includes an opening section, an operating section and a supporting section which are disposed in substantially the same plane. A substantially U-shaped groove is provided between one end portion of the opening section and one end portion of the operating section. The supporting section surrounds a portion of the opening section and the operating section. The operating section is linked to and supported by the supporting section through axles. The opening section, the operating section and the supporting section are integrated through a thin wall portion and the support axles by molding. When the other end portion of the operating section is raised, the axles are twisted and the operating section rotates about the axles to close groove. Accordingly, the end portion of the opening section is pressed by the end portion of the operating section and the part of the container located beneath the opening section is opened by the opening section.

16 Claims, 6 Drawing Sheets

DEVICE FOR FORMING A MOUTH IN A CONTAINER

FIELD OF THE INVENTION

The present invention generally relates to a device for attachment to a container. More particularly, the present invention pertains to a device adapted to be mounted on a container formed mainly of a paper or plastic to provide a mouth or pouring mechanism for the container.

BACKGROUND OF THE INVENTION

The mouth or pour opening in a container formed primarily of paper or plastic is generally sealed by covering the opening in the container with a film-like sheet or a pull-tab made of a resin. To open the container opening, the sheet or pull-tab is peeled or a straw is inserted through the sheet to pierce the sheet.

This use of a sheet which is peeled off the container or a pull-tab which is pierced with a straw does, however, present certain disadvantages and drawbacks. In one respect, the sheet, pull-tab and straw constitute rubbish separate and apart from the container itself and such items are liable to be easily thrown away.

There are containers in which only part of the sheet or pull-tab is peeled so that they are not completely separated from the containers. These containers have a problem because, when the sheet or pull-tab is released after opening, the mouth or opening in the container can be blocked by the released sheet or pull-tab. In containers made of a metal such as aluminum, a mouth structure is known in which, once the container is opened, the opened state is held. However, containers which are formed mainly of a paper or a plastic and which have such a mouth structure are not available. Thus, a need exists for a device which is adapted to be mounted on a container made primarily of paper or plastic and which serves as a mouth or pouring arrangement for the container.

SUMMARY OF THE INVENTION

In light of the foregoing, the present invention provides a mouth forming device which is adapted to be used in conjunction with a container formed mainly of a paper or a plastic and which has a simple structure.

In accordance with one aspect of the present invention, a container mouth forming device for forming a mouth in a container formed mainly of a paper or plastic, includes an opening section operable to form an opening in a part of the container, an operating section for operating the opening section, and a supporting section secured to the container for supporting the operating section. The opening section and the operating section are positioned opposite to each other with a substantially U-shaped groove provided between the opening section and the operating section. The U-shaped groove has a thin wall portion and the operating section is connected to and supported by the supporting section through projecting support axles provided on both sides of the groove at positions spaced apart from the groove by a predetermined distance. The opening section, the operating section and the supporting section are integrated through the thin wall portion and the support axles by molding.

To open the part of the container that is to be opened to form a mouth or pouring opening, a portion of the operating section opposite the opening section is raised to rotate the operating section about the support axles. As a result, the operating section and the opening section are bent at the thin wall portion, so that the opening section is pressed by the operating section and a portion of the opening section opposite the operating section is pressed downward, whereby the part of the container to be opened is broken with the opening section.

The opening section has a flexible engaging member that is adapted to engage, from above, an engaging step portion formed in the supporting section. Thus, when a portion of the operating section opposite the opening section is raised, the operating section rotates about the support axles so that the groove is closed, the opening section is pressed by the operating section, the engaging member is deformed and is disengaged from the engaging step, a portion of the opening section opposite the operating section is pressed downward, and the part of the container located beneath the opening section is opened with the opening section.

The engaging member projects from the opening section toward the supporting section, and each of the support axles extends obliquely from the operating section toward the supporting section and has an axial cross-section possessing a laterally extending portion extending along a plane formed by the opening section and the operating section. The supporting section can be provided with an opening maintaining member that is adapted to engage the opening section when the opening section is pressed downward to form an opening in the container, and this opening maintaining member is designed to restrict the upward rotational movement of the opening section.

Also, the operating section preferably has an engaging part that is adapted to engage, from below, an engaging step part formed on the supporting section so that when the portion of the operating section opposite the part to be opened is pulled down after the opening section has opened the container part to be opened, the engaging part is passed over the engaging step part to a location beneath the engaging step part and is engaged by the engaging step to prevent the upward movement of the operating section. Thus, the upward movement of the operating section is prevented when the operating section is pulled down, after the part of the container to be opened is opened, to bring the engaging part into engagement with the engaging step part. The opening section has a lower surface at a portion opposite the operating section and the lower surface can be provided with a protrusion for effecting an opening in the container during operation of the operating section and downward movement of the opening section.

The supporting section is preferably provided with an outer peripheral portion that is smoothly inclined downward so as to be flush with the surface of the container on which the mouth-forming device is mounted. The opening section can also provided with a resin charging portion used to integrally mold the opening section, the operating section and the supporting section. This allows the resin charged into the mold cavity during molding of the mouth-forming device to flow from the opening section to the operating section via the thin wall portion and to pass to the supporting section through the support axles.

According to another aspect of the invention, a container mouth forming device for forming a mouth in a container that is formed primarily of paper or plastic includes a supporting section adapted to be attached to the outer surface of the container, an operating section connected to and supported on the supporting section, and an opening section connected to the operating section. The opening section has a first end portion and an oppositely located second end portion, while the operating section also has a first end portion and an oppositely located second end portion. The operating section is positioned relative to the opening section so that the first end portion of the opening section is located adjacent to the first end portion of the operating section with a gap being located between the first end portion of the opening section and the first end portion of the operating section. The operating section is designed to be rotatable about an axis with rotation of the operating section in an upward direction closing the gap and causing the first end portion of the operating section to engage the first end portion of the opening section to move the opening section downwardly so that the lower surface of the opening section extends below the lower surface of the supporting section. This downward movement of the opening section causes the opening section to contact the container wall and form an opening in the container.

BRIEF DESCRIPTION OF THE DRAWING FIGURES

Further details and features of the present invention will become more apparent from the detailed description set forth below considered in conjunction with the accompanying drawing figures in which like elements are designated by like reference numerals and wherein.

DETAILED DESCRIPTION OF A PREFERRED EMBODIMENT

Figure 1:
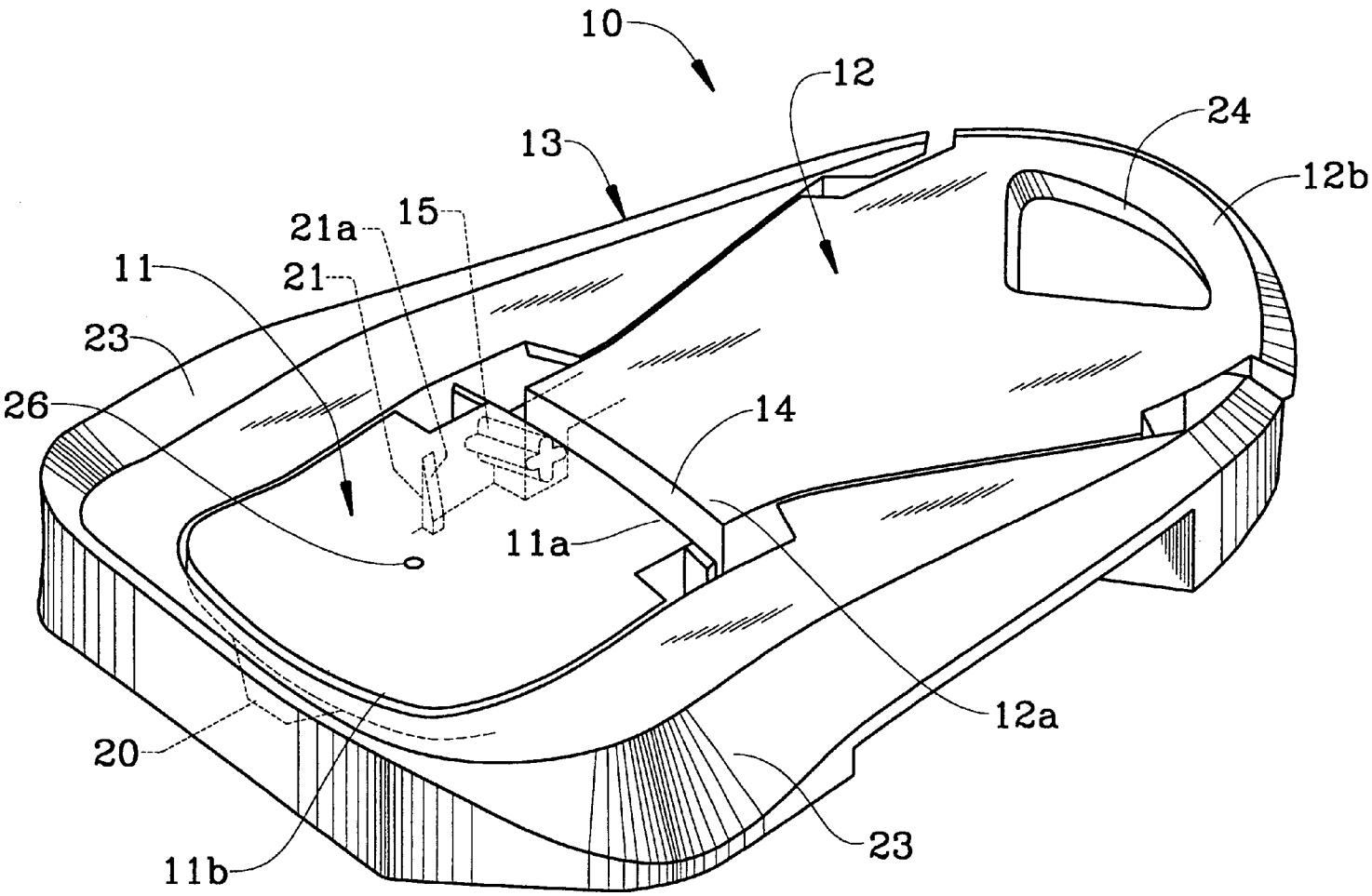
FIG. 1 is a top perspective view of an embodiment of a mouth-forming device according to the present invention.
Figure 2:
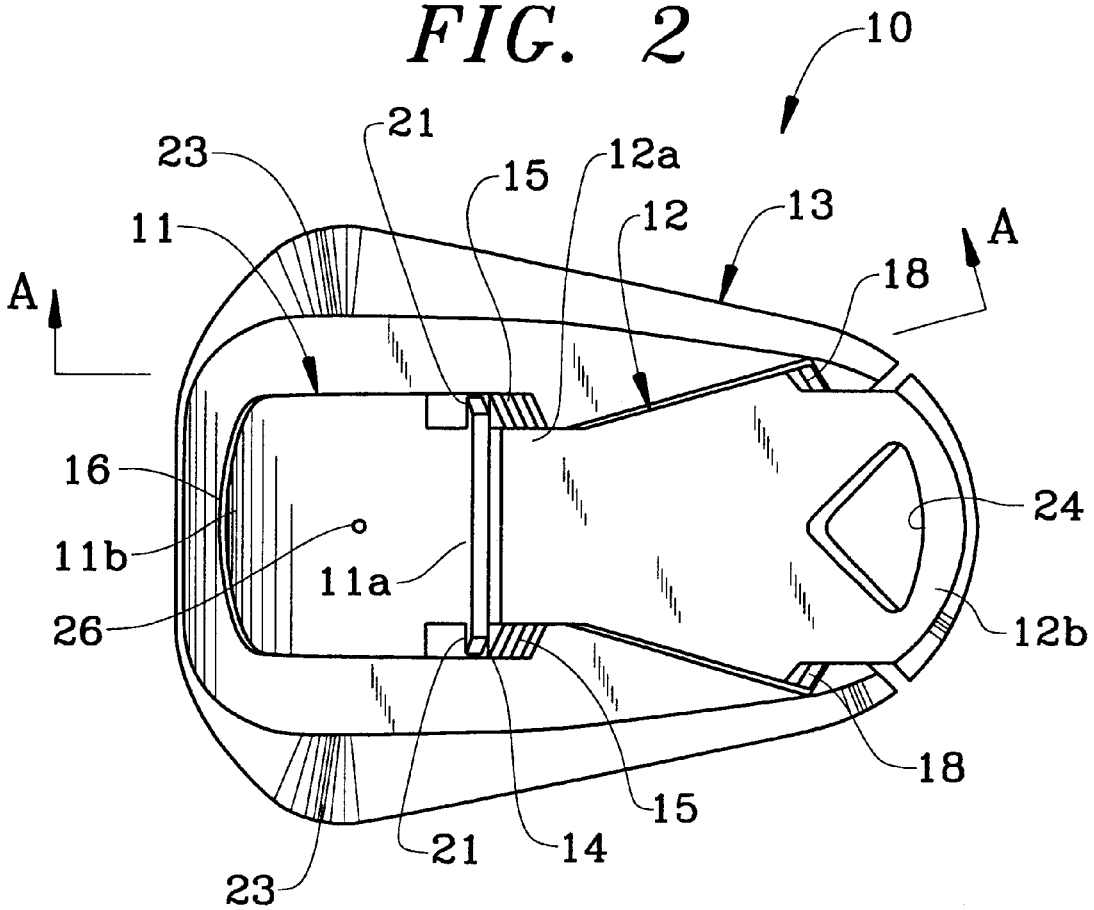
FIG. 2 is a plan view of the mouth-forming device shown in FIG. 1.
Figure 3:
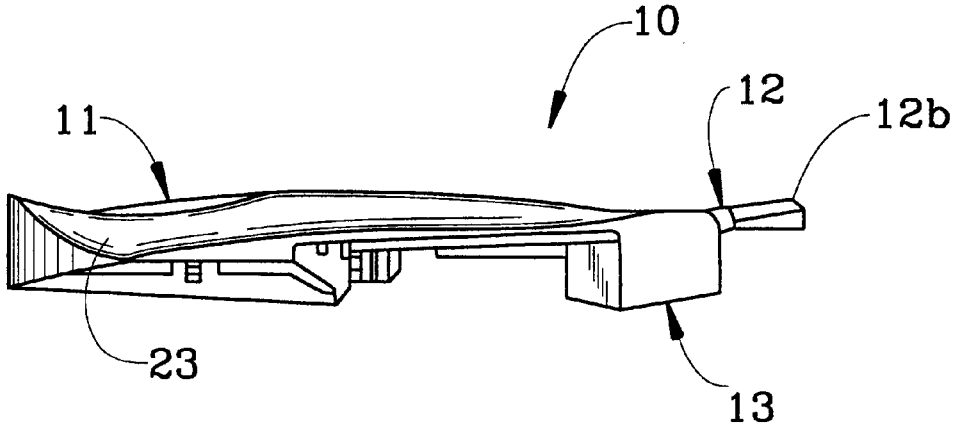
FIG. 3 is a side view of the mouth-forming device shown in FIG. 1.

As seen with reference to FIGS. 1–3, the mouth-forming or pouring device 10 according to the present invention, which is adapted to be mounted on a container that is primarily made of paper or plastic, is plate-like in form and is made of a resin material. The device 10 includes an opening section 11 for opening a mouth or a hole in a container, an operating section 12 for operating the opening section 11, and a supporting section 13 for supporting the operating section 12 and for allowing the mouth forming device 10 to be secured on a container.

The opening section 11, the operating section 12 and the supporting section 13 are disposed on substantially the same plane. The opening section 11 includes a first end portion 11*a* and an oppositely located second end portion 11*b*. Similarly, the operating section 12 includes a first end portion 12*a* and an oppositely located second end portion 12*b*. The first end portion 11*a* of the opening section 11 is positioned in opposing relation to the first end portion 12*a* of the operating section 12. A gap or substantially U-shaped groove 14 is provided between the opposing first end portions 11*a*, 12*a* of the opening section 11 and the operating section 12. The substantially U-shaped groove 14 has an upper open end and a thin wall portion 14a (see FIGS. 6–9) which connects the opening section 11 and the operating section 12. The lowermost bottom portion of the groove 14 is formed in a smoothly varying arcuate shape rather than a sharp angular shape.

The supporting section 13 surrounds the opening section 11 as well as a predetermined portion of the operating section 12. As can be seen from FIGS. 1 and 2, the portion of the supporting section 13 which surrounds a substantial portion of the operating section 12 is continuous with the portion of the supporting section 13 which entirely surrounds the opening section 11. The operating section 12 is connected to and supported by the supporting section 13 through a support axle 15 provided on each side of the groove 14 at positions spaced apart from the groove 14 by a predetermined distance. The support axles 15 serve, in effect, as torsion bars through which the operating section 12 and the supporting section 13 are integrated to one another through molding.

As shown in FIG. 1, an opening projection 20 projects from the lower surface or underside of the end portion 11*b* of the opening section 11 at a position opposite the operating section 12 (i.e., at the second end 11*b* of the opening section 11). The opening projection 20 possesses a diameter or shape that gradually decreases towards its free end. The supporting section 13 has an outer peripheral portion 23 that is smoothly inclined downward so as to be flush with the surface of the container when the mouth-forming device 10 is mounted on a container.

Figure 5:
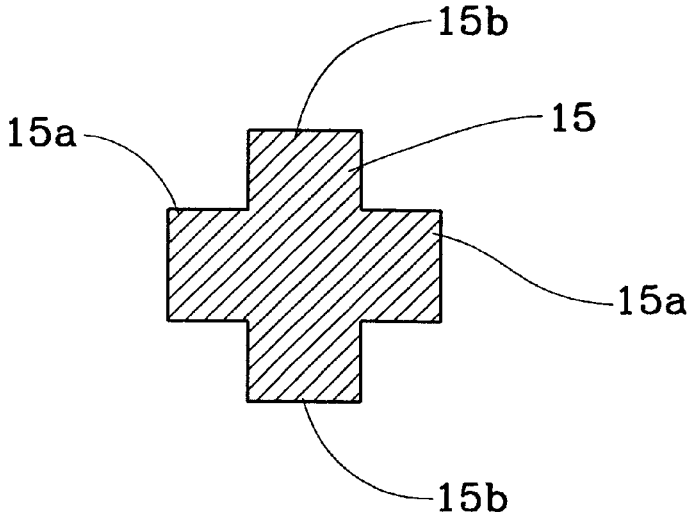
FIG. 5 is an enlarged, cross-sectional view of a support axis used in the mouth-forming device shown in FIG. 1.

As shown in FIG. 2, each support axle 15 extends obliquely from the operating section 12 toward the supporting section 13. Also, as shown in FIG. 5, each support axle has a lateral cross-section that is generally cross-shaped. The cross-shaped cross-section is defined by a horizontally extending portion 15*a* extending longitudinally along a plane formed by the opening section 11 and the operating section 12 and a vertically extending portion 15*b*. The horizontally extending portion 15*a* reinforces the support axles 15 to strongly withstand forces imparted to the support axles 15 in the horizontal direction (i.e., longitudinal direction along the plane defined by the opening section 11 and the operating section 12). The vertically extending portion 15*b* reinforces the support axle 15 to strongly withstand vertical forces imparted to the support axles 15. Thus, the support axles 15 are so constructed that they can be relatively easily twisted without being destroyed. While the support axles are described above as preferably having a generally cross-shaped lateral cross-section, it is understood that the present invention is not limited to such a configuration, but may be nearly a flat shape or a star shape with the horizontally extending portion being present.

The opening section 11, the operating section 12 and the supporting section 13 are integrated through the thin wall portion 14*a* and the support axles 15 during the molding operation. In this regard, a resin-charging portion used to integrally mold these three sections is provided in the opening section 11.

Figure 9:
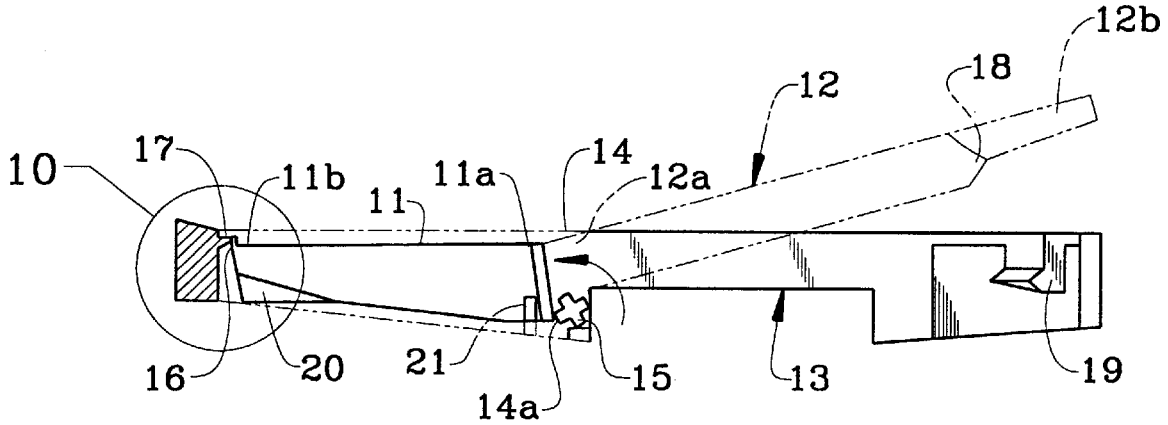
FIG. 9 is a cross-sectional view of the mouth-forming device taken along the section line A—A in FIG. 2 and showing the state of the mouth-forming device of FIG. 1 during use.
Figure 11:
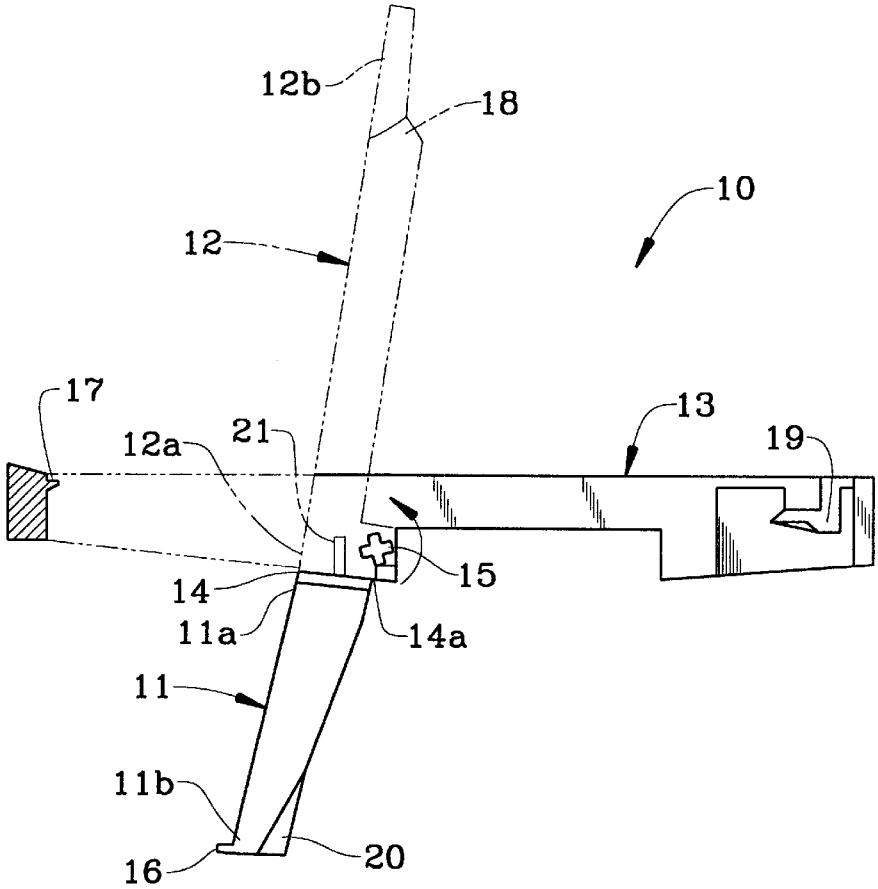
FIG. 11 is a cross-sectional view of the mouth-forming device taken along the section line A—A in FIG. 2 and showing the state of the mouth-forming device of FIG. 1 during use.

The mouth-forming device 10 of the present invention is adapted to be mounted on and fixed to an upper portion of a container formed mainly of paper or plastic. As shown in FIG. 9, when the second end portion 12*b* of the operating section 12 that is located remote from the opening section 11 is raised, the support axles 15 are twisted so that the operating section 12 rotates generally about the axes of the support axles 15. As a result, the groove 14 is closed and the first end portion 11*a* of the opening section 11 is pressed downwardly by the first end portion 12*a* of the operating section 12. Thus, as shown in FIG. 11, the second end portion 11*b*. of the opening section 11 that is located remote from the operating section 12 is pushed downwardly so that the opening section 11 opens the portion of the container located beneath or underlying the opening section 11.

Figure 6:
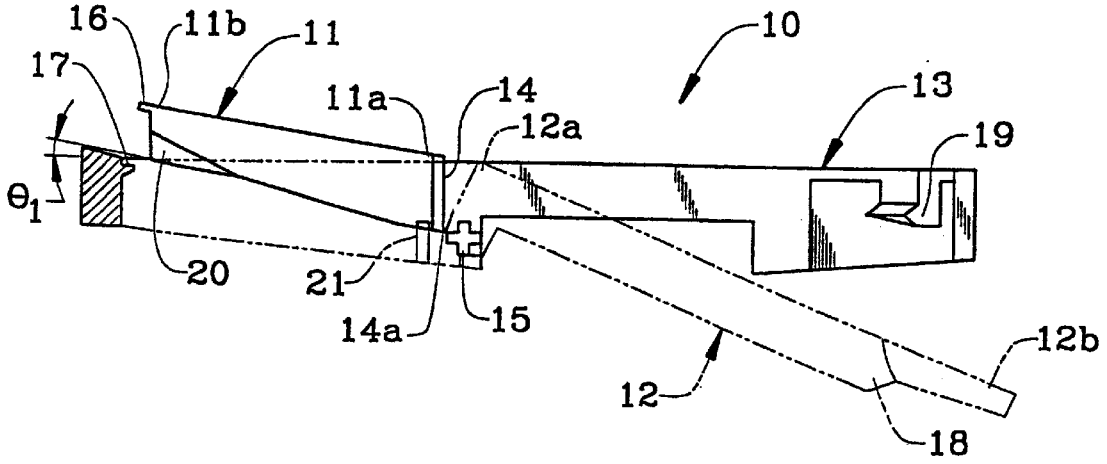
FIG. 6 is a cross-sectional view of the mouth-forming device taken along the section line A—A in FIG. 2 and showing the molding state of the mouth forming device of FIG. 1.

As shown in FIG. 6, the opening section 11 is provided with a flexible engaging member 16 that is adapted to engage, from above, an engaging step portion 17 formed on the supporting section 13. The engaging member 16 protrudes from the second portion 11*b* of the opening section 11 and extends in a direction away from the operating section 12. As shown in FIG. 9, when the second end portion 12*b* of the operating section 12 is raised, the operating section 12 rotates so that the groove 14 is closed and the first end portion 11*a* of the opening section 11 is pressed by the first end portion 12*a* of the operating section 12. As a result, and with reference to FIG. 10, the engaging member 16 is deformed and is disengaged from the engaging step 17 so that the second end portion 11*b* of the opening section 11 is pressed downwardly.

Figure 12:
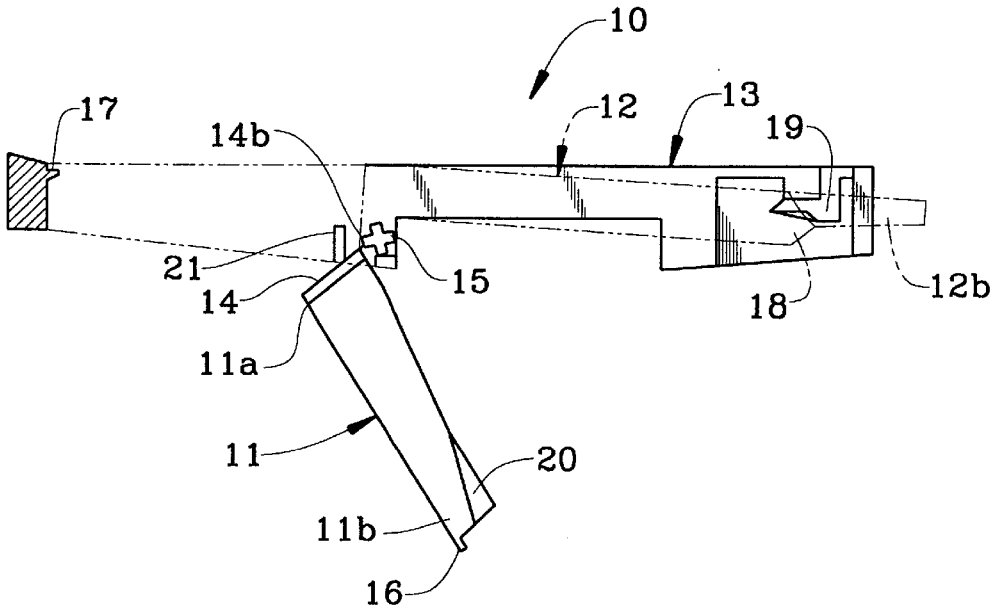
FIG. 12 is a cross-sectional view of the mouth-forming device taken along the section line A—A in FIG. 2 and showing the state of the mouth-forming device of FIG. 1 during use.

As shown in FIGS. 1 and 12, the supporting section 13 is provided with an opening maintaining member 21. When the opening section 11 has been pressed downwardly and has opened the underlying portion of the container to form an opening in the container wall, the opening maintaining member 21 engages the upper portion of the opening section 11 which has been pressed downward to restrict upward rotational movement of the opening section 11. As seen in FIG. 1, the opening maintaining member 21 has an upper surface 21*a* that is inclined so as to permit the opening section 11 to smoothly pass over the opening maintaining member.

As shown in FIG. 12, the second end portion 12*b* of the operating section 12 is provided with engaging parts 18 that are adapted to engage, from below, respective engaging step parts 19 formed on the supporting section 13. In this way, when the second end portion 12*b* of the operating section 12 is pushed or pulled downwardly after the opening section 11 has opened the underlying portion of the container, each engaging part 18 passes over the respective engaging step part 19 so that the engaging part 18 is located beneath the engaging step part 19. In this position, the engaging parts 18 are engaged by the engaging step 19 which thus prevents subsequent upward movement of the operating section 12. As seen in FIGS. 11 and 12, the upper and lower sides of the engaging step parts 19 are inclined to permit the engaging parts 18 to smoothly pass over the engaging step parts 19.

As shown in FIGS. 3 and 6, the second end portion 12*b* of the operating section 12 is thinner than the first end portion 12*a* and is provided with an opening or window portion 24 of generally triangular shape. This opening or window portion 24 functions as a pull ring for allowing the operating section 12 to be manipulated during use.

Figure 4:
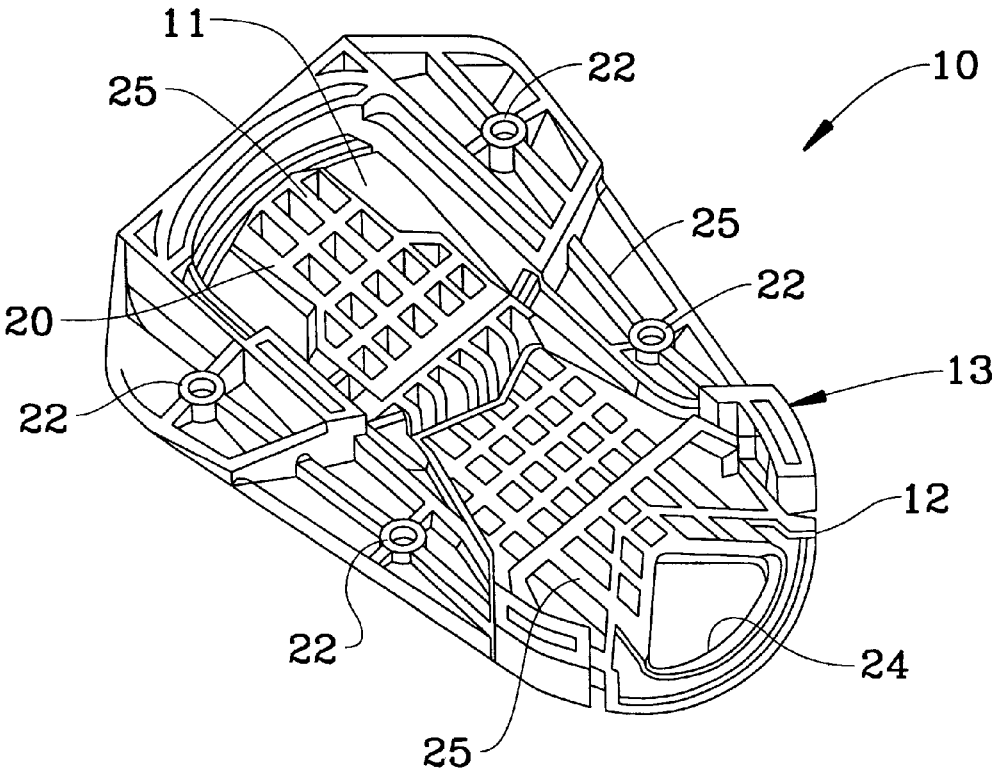
FIG. 4 is a bottom perspective view of the mouth forming device shown in FIG. 1.

As shown in FIG. 4, the lower sides of the opening section 11, the operating section 12 and the supporting section 13 are provided with reinforcing ribs 25 that protrude from the lower side and form a network structure. The portions of the network structure in the supporting section 13 at which the reinforcing ribs 25 cross are provided with cylindrical portions 22. These cylindrical portions 22 are used to locate the mouth forming device 10 at the proper position relative to a jig for securing the mouth forming device 10 on the container after the foregoing preparation and circulation stages.

In the illustrated embodiments, the lower surface of the supporting section 13, namely the side which is in contact with the container, is not made flat. Since the mouth forming device 10 of the illustrated embodiment is adapted to be mounted on the surface of a container which is formed by folding mainly paper into a polygonal columnar shape and which is not made perfectly flat, such a structure is designed to make the bonding easy. The bonding of the mouth-forming device to the container may be carried out in any known method such as by heat sealing using infrared ray heating.

Figure 7:
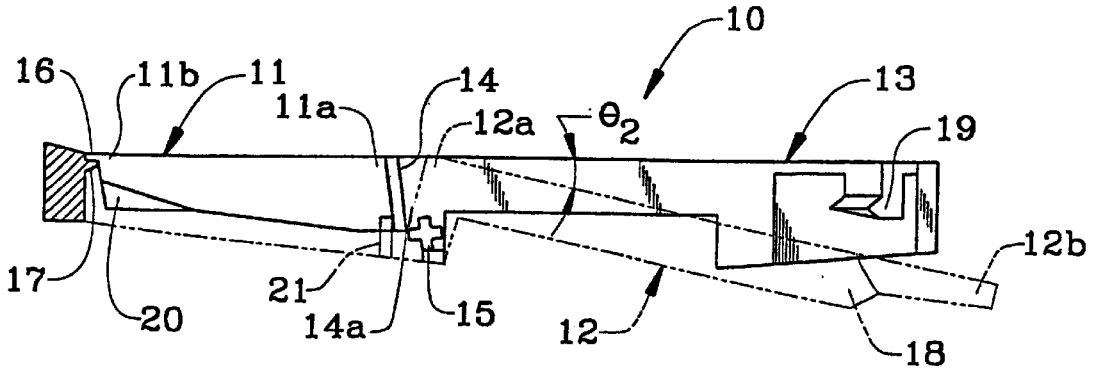
FIG. 7 is a cross-sectional view of the mouth-forming device taken along the section line A—A in FIG. 2 and showing the state of the mouth forming device of FIG. 1 from molding to just before use.

Having described the features of the mouth-forming device 10 of the present invention, the use and operation of the mouth-forming device 10 is as follows. As shown in FIG. 6, the mouth forming device 10 immediately after the molding is in such a state, with the consideration of the inclination for extraction from the molds, that the opening section 11 is inclined upward at an angle $\theta 1$ (about 5° to 15°) with respect to a horizontal plane and the operating section 12 is inclined downward at an angle greater than $\theta 1$. When the operating section 12 in such a state is raised, as shown in FIG. 7, the support axles 15 are twisted and the operating section 12 is rotated generally about the axles of the support axles 15. Thus, the opening section 11 connected thereto through the thin wall portion 14 is also rotated downward so that the engaging member 16 is engaged by the engaging step portion 17. In this state, the downward inclination angle $\theta 2$ of the operating section 12 is adjusted at about 10° from the horizontal.

Figure 8:
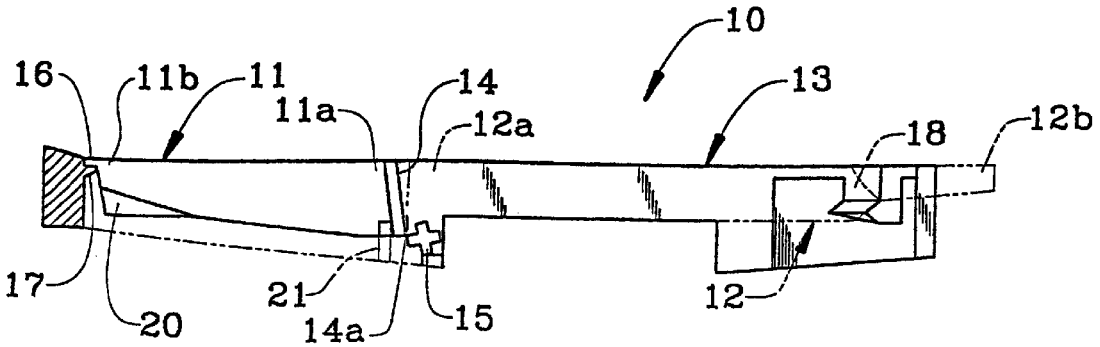
FIG. 8 is a cross-sectional view of the mouth-forming device taken along the section line A—A in FIG. 2 and showing the state of the mouth forming device of FIG. 1 just before use.

When the operating section 12 is further raised, the engaging part 18 passes over and engages with the engaging step part 19 while maintaining the engagement of the engaging member 16 with the engaging step portion 17, as shown in FIG. 8. In such a state, the mouth-opening device 10 is secured to the container.

To use the mouth forming device 10 once it is secured to the container, the second end portion 12*b* of the operating section 12 is raised to rotate the operating section 12 about the support axles 15. At this point, since the engaging part 18 is in engagement from above with the engaging step part 19, the second end portion 12*b* of the operating section 12 is maintained at a position spaced apart from the surface of the container by a predetermined distance. Further, since the second end portion 12*b* of the operating section is formed to have a small thickness, when the second end portion 12*b* of the operating section is engaged by a finger, the second end portion 12 side is bent so that a finger can be easily inserted between the surface of the container and the operating section 12. Thus, the second end portion 12*b* of the operating section 12 can be easily raised. Further, since the window 24 is formed on the second end portion 12*b* of the operating section 12 and since the periphery of the window 24 is easily bent, it is rather easy to insert a finger into the window 24.

Figure 10:
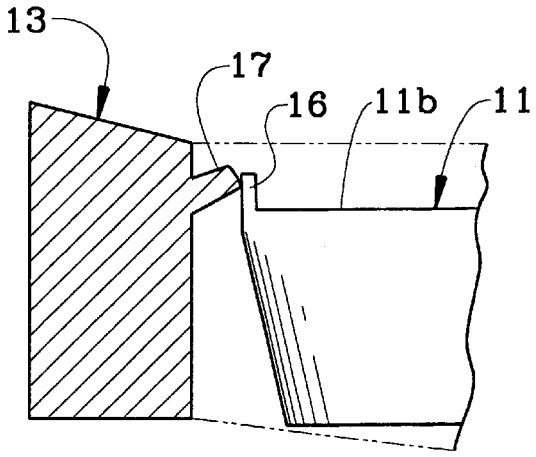
FIG. 10 is an enlarged view of the portion of the mouth-forming device designated B in FIG. 9.

When the operating section 12 is rotated upwardly, the operating section 12 and the opening section 11 are bent at the thin wall portion 14*a* so that the upper portion of the groove 14 is closed. Thus, the first end portion 11*a* of the opening section 11 is strongly pushed downward by the first end portion 12*a* of the operating section 12. Thus, as shown in FIG. 10, the engaging member 16 is deformed and disengaged from the engaging step portion 17 so that, as shown in FIG. 11, the second end portion 11*b* of the opening section 11 is forcibly pressed down. In this way, the opening section 11 moves so that the lower surface of the opening section 11 is positioned below the lower surface of the supporting section 13 as seen in FIG. 11. During the course of this movement of the opening section 11, the container portion underlying the opening section 11 is broken by the protrusion 20 provided on the lower side of the opening section 11. Thus, an opening is produced in the container.

Once the opening of the container is effected, the operating section 12 is further rotated to permit the opening section 11 to engage with the opening maintaining member 21, thus preventing upward movement of the opening section 11. Thereafter, as shown in FIG. 12, the operating section 12 is rotated in the opposite direction to pull down the second end portion 12*b* of the operating section until the engaging part 18 has once again passed over the engaging step part 19. Thus, the engaging part 18 is brought into engagement, from below, with the engaging step part 19 to prevent the upward movement of the operating section 12.

According to the mouth-forming device of the present invention as described above, by merely raising the second end portion 12*b* of the operating section 12 of the mouth forming device 10 which is secured on a container formed mainly or primarily of paper or plastic, the opening section 11 connected to the operating section 12 is rotated so that the part of the container to be opened which is located beneath the opening section 11 can be broken. Thus, no rubbish in addition to the container results.

Since the mouth forming device 10 of the present invention is constructed so that the opening section 11, the operating section 12 and the supporting section 13 are integrated through the thin wall portion 14*a* and the support axles 15 by molding with a resin material, it is not necessary to assemble a plurality of separately prepared parts together. Thus, the number of parts can be minimized so that the mouth-forming device 10 can be fabricated relatively easily and inexpensively.

Further, the provision of the flexible engaging member 16 which engages, from above, the engaging step portion 17 formed on the supporting section 13 is advantageous in that the opening section 11 is prevented from moving downwardly as long as the second end portion 12*b* of the operating section 12 is not forcibly raised. Therefore, the part of the container to be opened is not broken or opened prior to the manual opening operation during, for example, product shipping and handling, so that the sealed state of the container can be suitably maintained.

Further, when a strong downward force is applied to the opening section 11, the engaging member 16 is disengaged from the engaging step portion 17 and the protrusion 20 on the opening section 11 hits the part of the container to be opened with a strong force. Therefore, the part of the container to be opened can be easily and reliably broken.

Since the engaging member 16 projects from the second end portion 11*b* of the opening section 11 in the direction opposite the operating section 121 and since each of the support axles 15 extends obliquely from the operating section 12 towards the supporting section 13 and has a cross-section possessing a horizontally extending portion 15*a*, the support axles 15 have a strong structure able to withstand a force directed towards the side opposite the operating section 12. Therefore, even when the operating section 12 is raised to bring the engaging member 16 into engagement, from above, with the engaging step portion 17 and is thereafter further strongly raised, there is no fear of displacement of the support axles 15 towards the side opposite the operating section 12 (toward the opening section 11) which would result in the failure of the engaging member 16 to be disengaged from the engaging step portion 17. This further contributes to the ability to be able to easily and reliably open the part of the container to be opened. Since the supporting section 13 is provided with the opening maintaining member 21 that engages the opening section 11 after the opening of the part of the container to be opened to restrict the upward rotational movement of the opening section 11, the opened state of the part of the container to be opened is suitably maintained so that liquid can be discharged through the mouth in a suitable manner.

Further, since the operating section 12 is provided with the engaging part 18 that engages, from below, the engaging step part 19 formed on the supporting section 13, upward movement of the operating section 12 is prevented when the operating section 12 is pulled down after the part of the container to be opened has been opened, to bring the engaging part 18 into engagement with the engaging step part 19. As a result, a person can drink the contents from the mouth without hinderance.

Furthermore, by forming the second end portion 12*b* of the operating section 12 to be thin, the operating section 12 can be easily rotated for the opening of the part of the container to be opened, by engaging and raising the second end portion 12*b* with a finger.

Moreover, the provision of the protrusion 20 on the lower surface of the second end portion 11*b* of the opening section 11 having a diameter gradually decreasing toward its free end is advantageous in that the part of the container to be opened can be easily broken or ruptured with the protrusion 20. Further, during opening step, since the protrusion 20 contacts the contained liquid at the small diameter tip end, splashing of the liquid can be minimized.

Further, since the outer peripheral portion 23 of the supporting section 13, which a person touches with their lips during ingestion of the liquid, is configured to be smoothly inclined downward so as to be flush with the surface of the container, the person can drink without a sense of hinderance.

Additionally, by providing in the opening section 11 a resin charging portion 26 used in molding the mouth forming device 10, the resin charged into the mold cavity during molding flows from the opening section 11 to the operating section 12 via the thin wall portion 14*a* and is passed to the supporting section 13 through the support axles 15. If such a resin charging portion were formed in the operating section 12, the resin introduced into the mold cavity would flow mainly from the operating section 12 to the supporting section 13 via support axles 15 with the remaining portion being passed to the opening section 11 through the thin wall portion 14*a*. As a consequence, there is a fear that the thickness of the thin wall portion 14*a* would not be sufficiently secured. Thus, by providing the resin charging portion 26 in the opening section 11, the resin can be sufficiently fed to the thin wall portion 14*a* so that the thickness of the thin wall portion 14*a* can reliably be made uniform. Hence, the thin wall portion 14*a* which is subjected to bending can have a desired strength to prevent breakage of the thin wall portion 14*a* at the time of the opening operation. Further, since the lowermost portion of the groove 14 in the present embodiment is generally in a smoothly varying U-shaped form rather than in an acute angle, the thin wall portion 14*a* is not as liable to become broken.

The shape and the arrangement of the opening section 11, the operating section 12 and the supporting section 13 is not be limited only to the abovedescribed embodiment. Rather, any shape and arrangement can be used, preferably so long as the device is formed of a resin material, the device has opening, operating and supporting sections, the opening, operating and supporting sections are arranged in substantially the same plane, the opening and operating sections are linked to each other through a thin wall portion formed by providing a groove therebetween, and the supporting section is disposed to surround the opening section and a predetermined portion of the operating section that is continuous with the opening section.

In the above described embodiment, as the part of the container to be opened, an upper part of the container is made a mouth forming portion. Such a part can be provided with a thin groove to facilitate the formation of the mouth.

By merely raising the second end portion of the operating section of the mouth opening device secured on the container formed mainly of paper or plastic, the opening section connected to the operating section is rotated so that the part of the container to be opened which underlies the opening section can be broken. Thus, no rubbish is formed in addition to the container with the mouth forming device.

Since the above mouth forming device is formed by molding with a resin material into a unitary structure, it is not necessary to assemble a plurality of parts together. Thus, the number of parts can be minimized so that the mouth forming device can be fabricated easily and with low costs. Further, since the mouth or opening in the container can be formed by operating the operating section without directly contacting by hand the opening section which is immersed into the container, the structure is extremely hygienic.

In accordance with the present invention, the opening section is prevented from moving downward by the engagement of the engaging member with the engaging step portion, as long as that portion of the operating section opposite the opening section is not forcibly raised. Therefore, the part of the container to be opened is not broken prior to the opening operation so that the sealed state can be suitably maintained.

Further, when the opening section is applied with a strong downward force, the engaging member is disengaged from the engaging step portion and the underside of the opening section strongly impacts the part of the container to be opened. Therefore, the part of the container to be opened can be easily and reliably opened.

The support axles are advantageously constructed so that they possess strength sufficient to withstand a force directed towards the side opposite the operating section. Therefore, even when the operating section is raised to bring the engaging member into engagement, from above, with the engaging step portion and is thereafter further raised, there is no fear of displacement of the support axles toward the side opposite the operating section (toward the opening section) which would result in failure of the engaging member to be disengaged from the engaging step portion. This further contributes to being able to easily and reliably open the part of the container to be opened.

By virtue of the construction of the mouth-forming device of the present invention, the opened state of the part of the container to be opened is reliably maintained so that the liquid can be discharged through the mouth in a suitable manner. Also, the upward movement of the operating section is prevented when the operating section is pulled down, after the part of the container to be opened is opened, to bring the engaging part into engagement with the engaging step part. As a result, a person can drink the contents without interference from device since the operating section does not interfere.

Since the protrusion is provided on the lower surface of the opening section at a portion opposite the operating section, the part of the container to be opened can be easily broken with the protrusion. Further, during opening, since the protrusion contacts the liquid contents with its small diameter tip end, splashing of the drink can be minimized.

By configuring the outer peripheral portion of the support portion, which is to be touched by the upper lip of a person during consumption of the contents, is smoothly inclined downward so as to be flush with the surface of the container, the person can drink without a sense of uncomfortableness.

By providing the resin charging portion, which is used during molding, in the opening section, the thickness of the thin wall portion can reliably be made uniform as compared with a situation where such a resin charging portion is provided in the operating section. Thus, the thin wall portion which is subjected to bending possesses a desired strength to prevent breakage of the thin wall portion at the time of the opening operation.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A container mouth forming device for forming a mouth in a container that is formed primarily of paper or plastic, comprising a supporting section adapted to be attached to an outer surface of the container, an opening section supported on the supporting section for forming an opening in the container, an operating section for operating said opening section to form the opening in the container, said opening section and said operating section being positioned in opposing relation to each other with a U-shaped groove provided between said opening section and said operating section, said U-shaped groove having a thin wall portion, said operating section being connected to and supported by said supporting section through projecting support axles that are provided on both sides of said groove at positions spaced apart from said groove, said support axles having a cross-section that includes a laterally extending portion, and said opening section, said operating section and said supporting section being integrated through said thin wall portion and said support axles by molding.

2. A container mouth forming device according to claim 1, wherein said supporting section is provided with an engaging step portion and the opening section is provided with a flexible engaging member that is initially engageable with an upper side of the engaging step portion, whereby upon raising a portion of said operating section located remote from said opening section, said operating section rotates about said support axles to close said groove and presses upon said opening section to cause said engaging member to become disengaged from said engaging step so that a portion of said opening section located remote from said operating section is pressed downward to form an opening in said container.

3. A container mouth forming device according to claim 2, wherein said engaging member projects from said opening section in the direction opposite said supporting section and wherein each of said support axles extends obliquely from said operating section toward said supporting section, each support axle possessing a cross-shaped cross-section having a laterally extending portion that is horizontally arranged along a plane that is substantially parallel to a plane formed by said opening section and said operating section when said opening section and said operating section are in an initial position.

4. A container mouth forming device according to claim 2, wherein said supporting section is provided with an opening maintaining member that is engageable with said opening section when said opening section is pressed downward to form an opening in the container to restrict the upward rotational movement of said opening section.

5. A container mouth forming device according to claim 1, wherein said supporting section includes an engaging step part and said operating section has an engaging part that is engageable with a lower side of the engaging step part so that when a portion of said operating section is moved downwardly after said opening section has moved downwardly to form an opening in the container said engaging part passes over said engaging step part to a location beneath said engaging step part with said engaging step preventing upward movement of said operating section.

6. A container mouth forming device according to claim 1, wherein said opening section has a lower surface from which extends a protrusion having a shape that gradually decreases in size towards its free end, the protrusion being located at an end of the opening section remote from the operating section.

7. A container mouth forming according to claim 1, wherein said supporting section has an outer peripheral portion that is smoothly inclined downwardly.

8. A container mouth forming device for forming a mouth in a container that is formed primarily of paper or plastic, comprising a supporting section adapted to be attached to an outer surface of the container, an operating section connected to and supported on the supporting section, and an opening section connected to the operating section, said opening section possessing a lower surface and said supporting section possessing a lower surface, said opening section having a first end portion and an oppositely located second end portion, said operating section having a first end portion and an oppositely located second end portion, the operating section being positioned relative to the opening section so that the first end portion of the opening section is located adjacent to the first end portion of the operating section with a U-shaped gap being located between the first end portion of the opening section and the first end portion of the operating section, and a thin wall portion at a bottom of the U-shaped gap that interconnects the opening section and the operating section, the operating section being rotatable about an axis with rotation of the operating section in an upward direction closing said gap and causing the first end portion of the operating section to engage the first end portion of the opening section to move the opening section downwardly so that the lower surface of the opening section extends below the lower surface of the supporting section, the operating section being connected to the supporting section by a pair of support axles located on opposite sides of the U-shaped gap, the support axles each having a cross-shaped cross-section.

9. A container mouth forming device according to claim 8, wherein said supporting section is provided with an engaging step portion and the opening section is provided with a flexible engaging member that is initially engageable with an upper side of the engaging step portion, whereby upon upward rotation of said operating section said engaging member becomes disengaged from said engaging step.

10. A container mouth forming device according to claim 9, wherein said engaging member projects from said opening section in a direction away from said supporting section.

11. A container mouth forming device according to claim 8, wherein said operating section is connected to said supporting section by a pair of support axles located at opposite sides of the gap.

12. A container mouth forming device according to claim 11, wherein each support axle possesses a horizontally arranged portion.

13. A container mouth forming device according to claim 8, including an opening maintaining member provided on said supporting section, said opening section being engageable with the opening maintaining member upon downward movement of the opening section.

14. A container mouth forming device according to claim 8, wherein said operating section is rotatable downwardly after being rotated upwardly, said supporting section is provided with an engaging step part and said operating section is provided with an engaging part, said engaging part passing over said engaging step part upon downward rotation of said operating section so that the engaging part is located beneath said engaging step part and the operating section is inhibited from being rotated upward.

15. A container mouth forming device according to claim 8, including a protrusion extending from the lower surface of the opening section, the protrusion being located at the second end portion of the opening section.

16. A container mouth forming device according to claim 8, wherein said supporting section surrounds a portion of the opening section and surrounds less than the entirety of the operating section.

* * * * *